US006732541B2

(12) United States Patent
Urbank et al.

(10) Patent No.: US 6,732,541 B2
(45) Date of Patent: May 11, 2004

(54) ELECTRICALLY OPERATED COMPRESSOR CAPACITY CONTROL SYSTEM WITH INTEGRAL PRESSURE SENSORS

(75) Inventors: Thomas Martin Urbank, Lockport, NY (US); Karma Vir Sangwan, East Amherst, NY (US); Andrew J. Jackson, Darlington (GB); Michael S. Barnes, Gloucestershire (GB); Ernesto Jose Gutierrez, Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 39 days.

(21) Appl. No.: 10/267,725

(22) Filed: Oct. 9, 2002

(65) Prior Publication Data

US 2003/0029180 A1 Feb. 13, 2003

Related U.S. Application Data

(60) Provisional application No. 60/377,707, filed on May 3, 2002.

(51) Int. Cl.[7] ..... F25B 1/00; F04B 1/26

(52) U.S. Cl. ..... 62/228.3; 417/222.2

(58) Field of Search ..... 62/228.3, 228.5; 417/222.2, 222.1, 269, 270, 213; 74/60

(56) References Cited

U.S. PATENT DOCUMENTS 6,116,269 A 9/2000 Maxson ..... 137/487.5
6,511,297 B2 * 1/2003 Ota et al. ..... 417/222.2
6,589,020 B2 * 7/2003 Kimura et al. ..... 417/222.2
2002/0172602 A1 * 11/2002 Fukanuma et al. ..... 417/222.2

FOREIGN PATENT DOCUMENTS

EP 1162370 12/2001

OTHER PUBLICATIONS

"Electronic Control Valve with Integrated Pressure Sensor," Research Disclosure, Publication No. 41507 Nov. 1998.

* cited by examiner

*Primary Examiner*—Marc Norman

(57) ABSTRACT

A capacity control system for a variable capacity refrigerant compressor includes an internal bleed passage coupling a crankcase chamber of the compressor to a suction port, an electrically-operated two-port control valve that selectively opens and closes a passage between the crankcase chamber and a discharge chamber, and pressure sensors for measuring the compressor discharge pressure and suction pressure. A plunger of the control valve is disposed within the passage coupling the crankcase chamber and the discharge chamber, and a solenoid armature linearly positions the plunger within the passage to open and close the passage. The plunger has an axial bore that forms a continuous passage between the discharge chamber and a cavity in which the discharge pressure sensor is retained so that the sensor is continuously exposed to the discharge pressure regardless of the plunger position.

8 Claims, 3 Drawing Sheets

ELECTRICALLY OPERATED COMPRESSOR CAPACITY CONTROL SYSTEM WITH INTEGRAL PRESSURE SENSORS

PRIOR APPLICATION

This application claims priority of previously filed Provisional Patent Application No. 60/377,707 filed May 3, 2002.

FIELD OF THE INVENTION

This invention relates to a capacity control system for a variable capacity refrigerant compressor, including an electrically operated capacity control valve having one or more integral sensors for measuring at least the discharge pressure of the refrigerant.

BACKGROUND OF THE INVENTION

Variable capacity refrigerant compressors have been utilized in automotive air conditioning systems, with the compressor capacity being controlled by an electrically-operated control valve. In a typical implementation, the compressor includes one or more pistons coupled to a tiltable wobble plate or swash plate, and the control valve adjusts the pressure in a crankcase of the compressor to control the compressor capacity. In one common arrangement, for example, a linear or pulse-width-modulated solenoid coil is operated to linearly position (by dithering, for example) an armature of a four-port valve that alternately couples the crankcase of the compressor to the compressor discharge (outlet) and suction (inlet) passages. When the discharge passage is coupled to the crankcase, the crankcase pressure is increased to decrease the compressor capacity; when the suction passage is coupled to the crankcase, the crankcase pressure is decreased to increase the compressor capacity. One example of such a valve is shown in the U.S. Pat. No. 6,116,269 to Maxon, issued on Sep. 12, 2000.

Since an electrically-operated control of compressor capacity is typically based on the operating status of the system, sensors are required to measure the refrigerant temperature or pressure at various locations. For example, both the high-side or discharge pressure and the low-side or suction pressure are frequently measured for control purposes and for detecting abnormal operation of the system. The usual approach is to mount a pressure sensor on a suitable refrigerant conduit, but variability in the position and orientation of the sensor results in variations of the sensed pressure due to transport delay and/or pooling of the refrigerant. Consistent results can only be ensured if the sensors are integrated into the compressor or control valve. For example, the four-port valve shown in the above-mentioned U.S. Pat. No. 6,116,269 includes an integral pressure sensor for measuring the suction pressure of the compressor.

While the above-described approach can be used effectively to control compressor capacity, the cost of the control valve can be relatively high since an external discharge pressure sensor is still required, and a four-port control valve is relatively expensive to manufacture. Accordingly, what is needed is an electrically-operated control valve that is less expensive to manufacture, and that also includes an integral sensor for measuring the discharge pressure of the compressor.

SUMMARY OF THE PRESENT INVENTION

The present invention is directed to an improved capacity control system for a variable capacity refrigerant compressor including an internal bleed passage coupling a crankcase chamber of the compressor to a suction port, an electrically-operated two-port control valve that selectively opens and closes a passage between the crankcase chamber and a discharge chamber, a suction pressure sensor within the control valve for measuring the compressor suction pressure and a discharge pressure sensor within the control valve that is continuously coupled to the discharge chamber for measuring the compressor discharge pressure. A plunger of the control valve is disposed within the passage coupling the crankcase chamber and the discharge chamber, and a solenoid armature linearly positions the plunger within the passage to open and close the passage. The plunger has an axial bore that forms a continuous passage between the discharge chamber and a cavity in which the discharge pressure sensor is retained so that the sensor is continuously exposed to the discharge pressure regardless of the plunger position. The solenoid armature includes a movable coil that interacts with a stationary pole piece including one or more permanent magnets, and balance guides formed on the plunger minimize the magnetic force required to move the plunger.

BRIEF DESCRIPTION OF THE DRAWING

The present invention will now be described, by way of example, with reference to the accompanying drawings in which:

FIG. 3 depicts the control valve in an electrically activated condition, and in an orientation that shows electrical connections for a movable coil within the valve.

FIG. 4 depicts the control valve in an electrically de-activated condition, and in an orientation that shows the integral pressure sensors and their electrical connections.

DESCRIPTION OF THE PREFERRED EMBODIMENT

Figure 1:
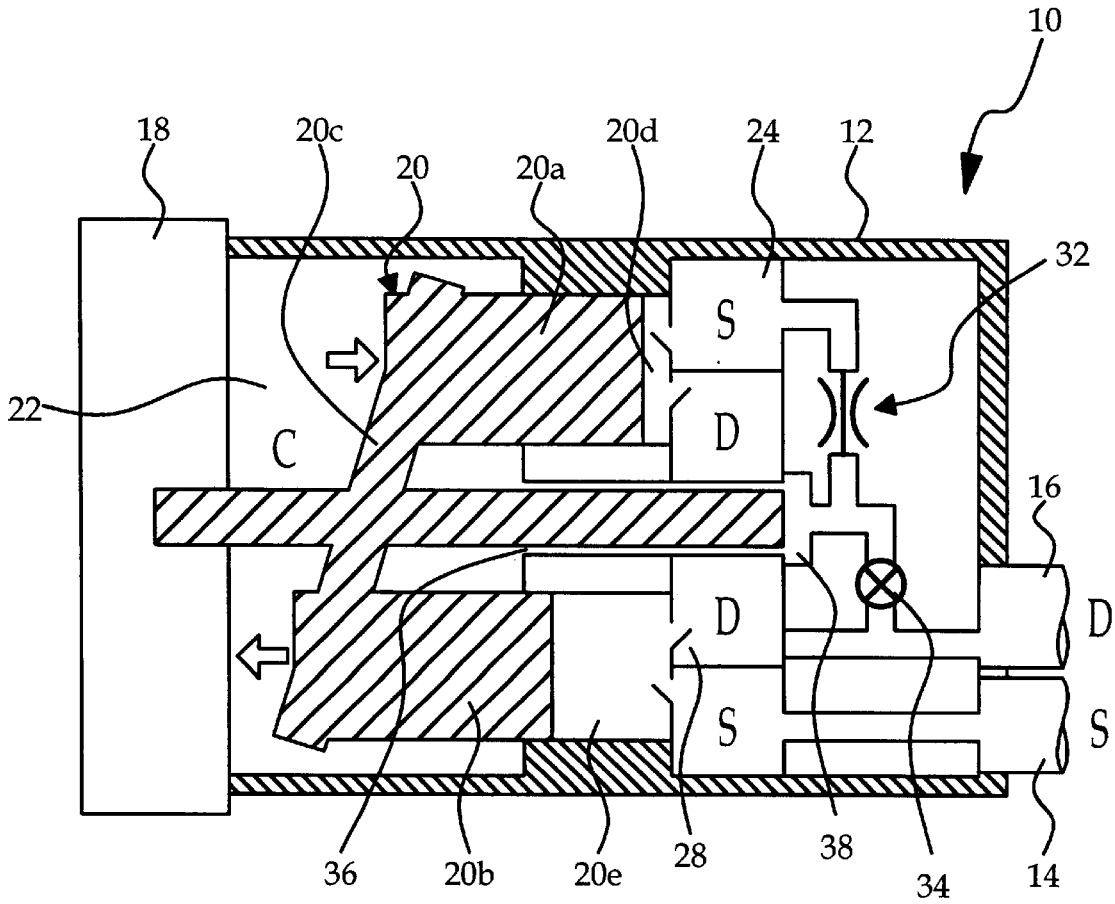
FIG. 1 is a schematic diagram of a variable capacity refrigerant compressor according to this invention.

Referring to FIG. 1, the reference numeral 10 generally designates a variable capacity refrigerant compressor according to this invention. The compressor 10 includes a cylindrical housing 12, a suction (inlet) pipe 14, a discharge (outlet) pipe 16, and a rotary drive mechanism 18 which may take the form of a belt-driven pulley and an electrically activated clutch. Typically, the drive mechanism 18 is coupled to a rotary shaft of a vehicle engine, but other drive arrangements are also possible. The drive mechanism 18 is drivingly coupled to a pumping mechanism 20 disposed in a crankcase 22 of the compressor 10. In general, the pumping mechanism 20 receives gaseous refrigerant at low pressure from an annular suction (S) chamber 24, and supplies gaseous refrigerant at high pressure to an annular discharge (D) chamber 28. In a common configuration, the pumping mechanism 20 includes one or more reciprocating pistons 20*a*, 20*b* coupled to a tiltable wobble plate or swash plate 20*c*, and flow control valves couple the chambers 24 and 28 to cylinders 20*d*, 20*e* in which the pistons 20*a*, 20*b* reciprocate. The piston stoke, and hence the compressor pumping capacity, is varied by adjusting the tilt angle of the plate 20*c*.

In the illustrated embodiment, adjustment of the tilt angle of plate 20*c* is achieved by controlling the refrigerant pressure in the crankcase 22; increasing the pressure in crankcase 22 decreases the tilt angle to decrease the pumping capacity, while decreasing the pressure in crankcase 22 increases the tilt angle to increase the pumping capacity.

In a conventional arrangement, the crankcase pressure is controlled by a four-port control valve such as depicted in the aforementioned U.S. Pat. No. 6,116,269 that alternately couples the crankcase 22 to the suction and discharge pipes 14, 16. According to the present invention, however, the crankcase pressure is controlled by the combination of a bleed passage 32 coupled between the crankcase 22 and suction pipe 14, and a two-port control valve 34 that selectively couples the crankcase 22 to the discharge pipe 16. Referring to FIG. 1, the annular passage 36 couples the crankcase 22 to a chamber 38, with the bleed passage 32 being coupled between the chamber 38 and suction chamber 24, and the control valve 34 being coupled between the chamber 38 and the discharge pipe 16. The bleed passage 32 may be implemented by simply drilling a passage between chambers 24 and 38, and the two-port control valve 34 is significantly less expensive to manufacture than the conventional four-port control valve. Overall system cost is further reduced according to this invention by integrating at least a discharge pressure sensor into the control valve 34, and preferably a suction pressure sensor as well.

Figure 2:
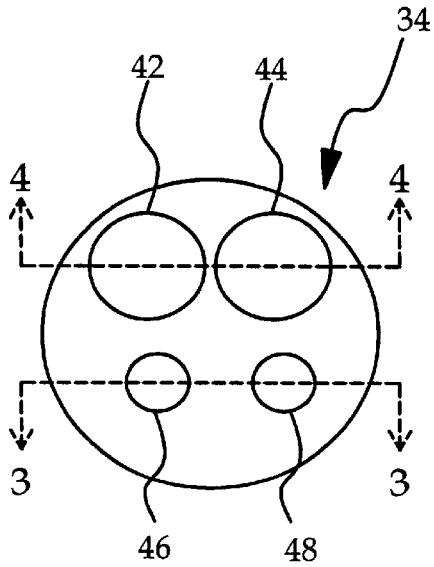
FIG. 2 is an end-view diagram of an electrically-operated control valve with integral pressure sensors according to this invention.
Figure 3:
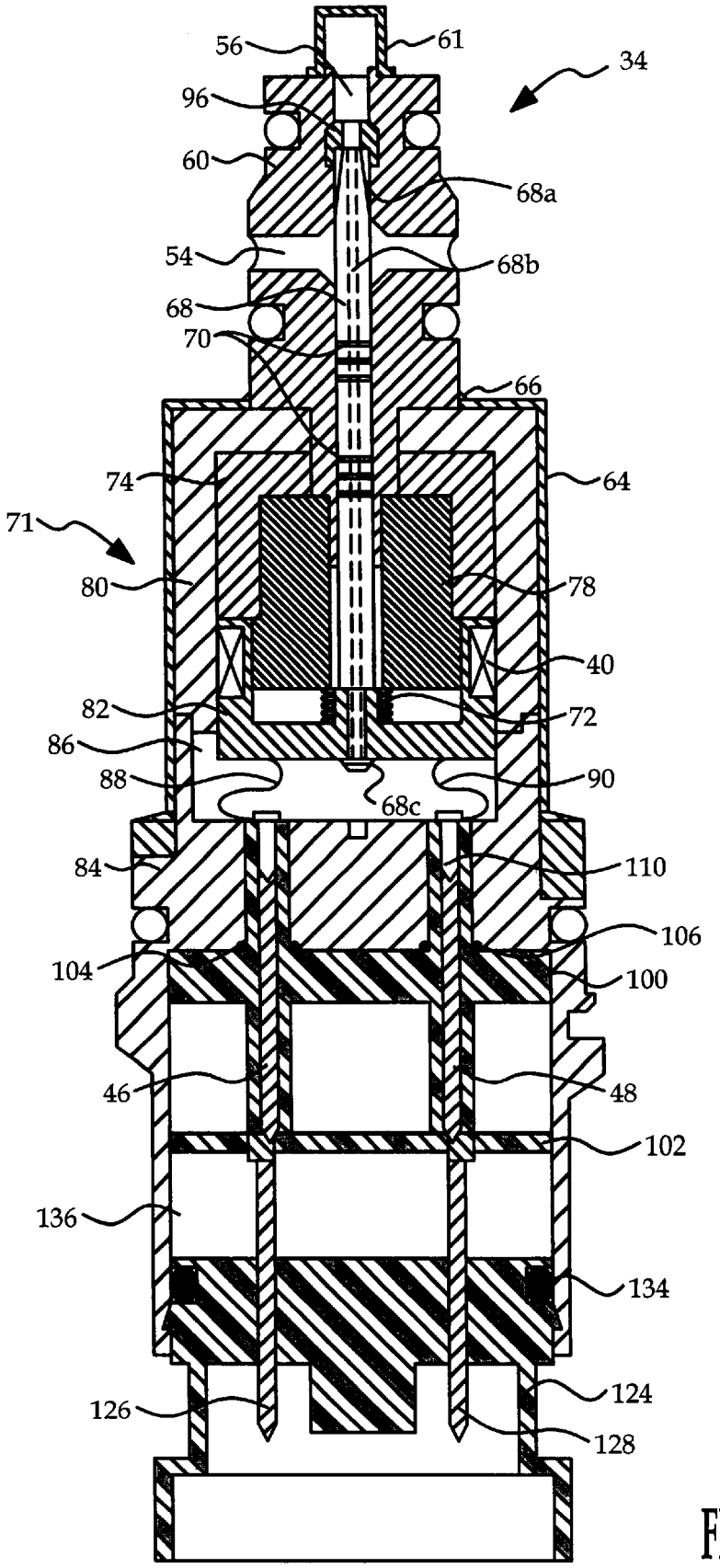
FIG. 3 is a cross-sectional view of the control valve of FIG. 2 taken along lines 3—3 of FIG. 2.
Figure 4:
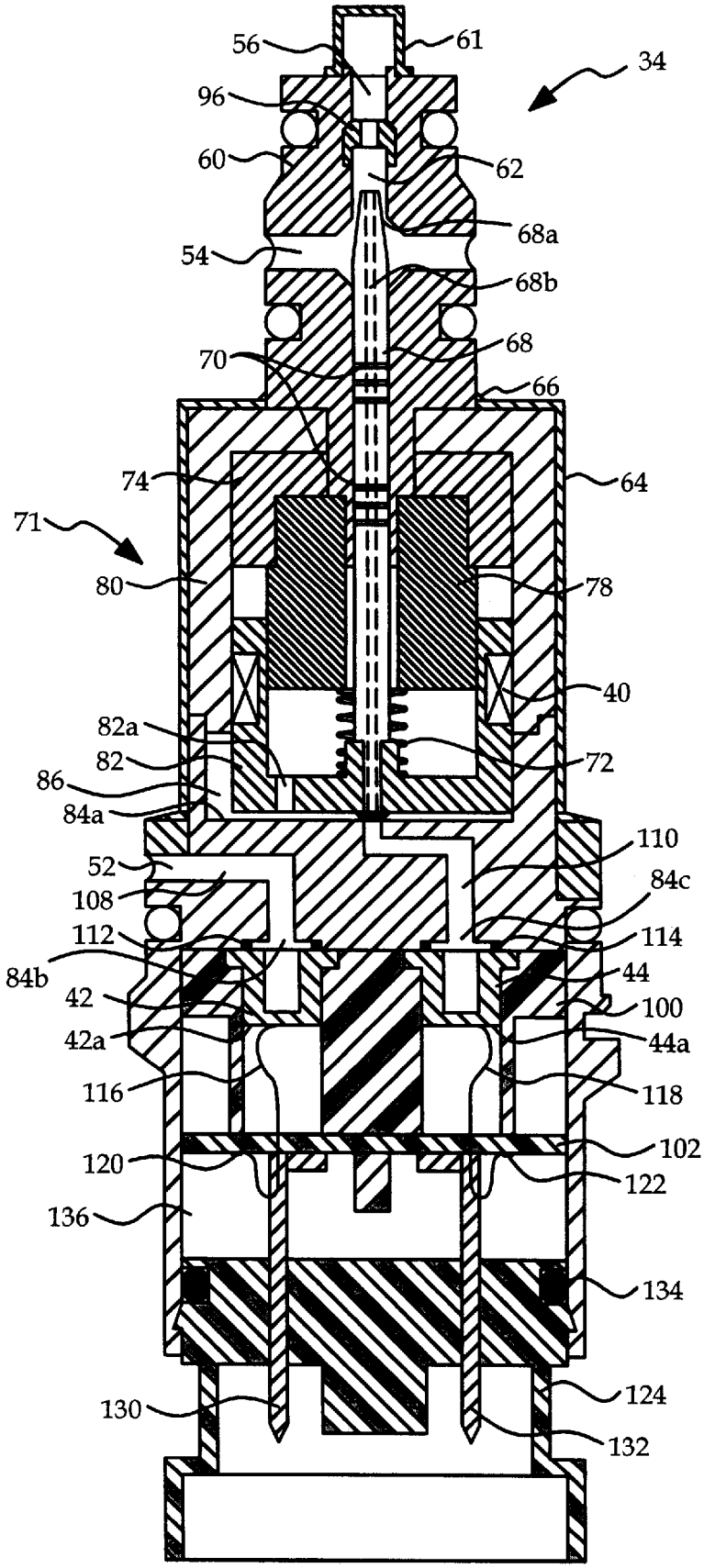
FIG. 4 is a cross-sectional view of the control valve of FIG. 2 taken along lines 4—4 of FIG. 2.

FIGS. 2–4 depict the control valve 34 in further detail. In general, the control valve 34 includes an electrically activated movable coil 40, and in the illustrated embodiment, includes a pair of integral pressure sensors 42, 44 for independently measuring the suction and discharge pressures. FIG. 2 is an end-view diagram of the valve 34, depicting the placement of the sensors 42, 44 and terminal posts 46, 48 for supplying electrical activation signals to the movable coil 40. FIG. 3 is a cross-sectional view of the control valve 34 taken along lines 3—3 of FIG. 2, and FIG. 4 is a cross-sectional view of control valve 34 taken along lines 4—4 of FIG. 2. Additionally, FIG. 3 depicts the control valve 34 in an electrically activated condition, whereas FIG. 4 depicts the control valve 34 in an electrically de-activated condition.

Referring to FIGS. 3 and 4, the control valve 34 is designed to be mounted in the rear-head of compressor 10 such that the ports 52, 54 and 56 are respectively placed in communication with chambers containing the compressor suction, crankcase and discharge pressures. The crankcase and discharge ports 54 and 56 are formed in a pressure port 60, with the discharge port 56 being defined by the inboard end of a central axial bore 62 passing through pressure port 60. A screen 61 prevents any foreign matter from entering the discharge port 56. The pressure port 60 is secured to a housing shell 64 by a weld 66, and a plunger 68 partially disposed within the bore 62 is axially positioned such that its inboard end 68*a* either opens or closes a portion of bore 62 that couples the crankcase and discharge ports 54 and 56. The portion of plunger 68 that is disposed within the bore 62 is provided with a set of balance grooves 70 that tend to fill with refrigerant during operation of the compressor 10. Lubricating oil is ordinarily suspended in the refrigerant, and the oil captured in the grooves 70 tends to laterally balance plunger 68 within the bore 62, minimizing the force required to axially displace plunger 68.

The housing shell 64 encloses an electrically activated solenoid assembly 71 for positioning the plunger 68 within the bore 62, including a spring 72 for biasing the plunger 68 to a retracted position (as depicted in FIG. 4) in which refrigerant is permitted to flow from the discharge port 56 to the crankcase port 54. As explained below, activating the solenoid assembly 71 produces a force that opposes the bias of spring 72 and moves the plunger 68 to an extended position (as depicted in FIG. 3) in which its outboard end 68*a* blocks the portion of bore 62 between discharge port 56 and crankcase port 54. The plunger 68 additionally has a central axial bore 68*b* extending its entire length for coupling discharge port 56 to the pressure sensor 44, as explained below.

The solenoid assembly 71 includes a set of permanent magnets (depicted as a single magnet 74 for the sake of clarity) disposed between inner and outer pole pieces 78 and 80, and a cup-shaped spool 82 carrying the movable coil 40. The spool 82 is secured to an outboard portion 68*c* of plunger 68, and a housing piece 84 partially encased by the housing shell 64 defines a cavity 86 outboard of the spool 82. The spring 72 is disposed around the plunger 68 between the spool 82 and the inner pole piece 78 to bias plunger 68 to the retracted position shown in FIG. 4. The flexible conductors 88, 90 couple the coil 40 to the terminal posts 46, 48, and electrically energizing coil 40 via posts 46, 48 and conductors 88, 90 produces a magnetic field that attracts the spool 82 toward the permanent magnet 74, moving the spool 82 and plunger 68 to the extended position depicted in FIG. 3. During energization of coil 40, the inboard tip of plunger 68 engages an annular stop 96 disposed in the pressure port bore 62 as seen in FIG. 3, whereas during deenergization of coil 40, the outboard tip of plunger 68 engages the inboard end 84*a* of housing piece 84 as seen in FIG. 4. Due to the plunger bore 68*b*, the cavity 86 contains discharge refrigerant, and one or more openings 82*a* formed in the spool 82 ensure pressure equalization across the base of spool 82 during its movement.

In addition to providing a stop for the plunger 68, the housing piece 84 provides a leak-proof interface for the terminal posts 46, 48 and the pressure sensors 42, 44. Referring to FIG. 3, the terminal posts 46, 48 are disposed within a spacer element 100 secured within the housing piece 84 such that the inboard ends of the terminal posts 46, 48 protrude into cavity 86 and the outboard ends protrude through a circuit board 102, also disposed within the housing piece 84. Rubber O-rings 104, 106 are compressed between the spacer element 100 and the housing piece 84 as shown to prevent refrigerant leakage past the terminal posts 46, 48. Referring to FIG. 4, the spacer element 100 also positions and retains the pressure sensors 42, 44 with respect to suction and discharge passages 108, 110 formed within the housing piece 84. In each case, an O-ring 112, 114 is compressed between the spacer element 100 and a cavity 84*b*, 84*c* of the housing piece 84 as shown to prevent refrigerant leakage past the respective pressure sensor 42, 44. The suction passage 108 couples the cavity 84*b* to the suction port 52 so that the pressure sensor 42 measures the compressor suction pressure. The discharge passage 110 couples the cavity 84*c* to the cavity 86 so that the pressure sensor 44 measures the compressor discharge pressure. Significantly, the opening of discharge passage 110 into cavity 86 is directly aligned with the plunger bore 68*b* so that the discharge passage 110 is in direct communication with the discharge port 56 regardless of the position of plunger 68.

The pressure sensors 42, 44 are preferably conventional stainless steel pressure sensors, each having a diaphragm 42*a*, 44*a* that is subject to flexure due to the pressure differential across it. The mechanical strain associated with the flexure is detected by a piezo-resistor circuit (not depicted) formed on the outboard surface of respective sensor diaphragm 42*a*, 44*a*, and flexible conductors 116, 118 couple the respective piezo-resistor circuits to bond pads 120, 122 formed on the circuit board 102. A connector 124 is secured to the outboard end of housing piece 84, and a set of terminals 126, 128, 130, 132 passing through connector 124 are soldered to the circuit board 102. As indicated in FIGS. 3 and 4, the terminals 126 and 128 are coupled to the terminal posts 46 and 48, and the terminal posts 130 and 132 are coupled to the bond pads 120, 122. An O-ring 134 compressed between the connector 124 and the housing piece 84 seals the enclosed area 136 from environmental pressures so that the pressures measured by the sensors 42 and 44 can be calibrated to indicate the absolute pressure of the refrigerant in the respective suction and discharge passages 108 and 110, as opposed to a gauge pressure that varies with ambient or barometric pressure. The O-ring 134 is retained in a recess of housing piece 84, and the connector 124 may be secured to the housing piece 84 by swaging as indicated.

In operation, the energization of movable coil 40 is modulated (by pulse-width-modulation, for example) to dither the plunger within the bore 62 to control the refrigerant pressure in crankcase 22. The configuration of solenoid assembly 71 with the movable coil 40 and stationary permanent magnet 74 significantly reduces the electrical power required to activate the valve 34, compared to a conventional fixed-coil design. The power requirement is additionally reduced by the balance grooves 70, which minimize the frictional forces acting on the plunger 68. In one implementation of this invention, for example, the maximum required coil current was only 300 mA, compared to a 1000 mA maximum current requirement in a conventional fixed-coil design, and the average current requirement under all operating conditions was reduced by at least 67%, compared to a conventional fixed-coil design. This reduction in the power requirement is particularly important in automotive applications because the generated electrical power is limited, particularly at low engine speeds. The system cost is also significantly reduced compared with a conventional approach since the bleed passage 32 enables the use of a two-port valve instead of the traditional four-port valve, and the suction and discharge pressures are continuously and accurately measured by the internal sensors 42 and 44.

While the present invention has been described in reference to the illustrated control valve 10, it will be recognized that various modifications in addition to those mentioned above will occur to those skilled in the art. For example, the suction pressure sensor 42 may be omitted, and either or both of the pressure sensors may be replaced with temperature sensors since the relationship between pressure and temperature of refrigerant in a closed volume system is known. Accordingly, capacity control systems incorporating such modifications may fall within the intended scope of this invention, which is defined by the appended claims.

What is claimed is:

1. Capacity control apparatus for a refrigerant compressor having a pumping capacity that varies according to a refrigerant pressure in a crankcase chamber thereof, the compressor additionally having a refrigerant inlet chamber and a refrigerant outlet chamber, the capacity control apparatus comprising:

a refrigerant bleed passage for continuously permitting refrigerant flow from said crankcase chamber to said inlet chamber;

a two-port control valve that selectively opens and closes a passage between the crankcase and outlet chambers for permitting the refrigerant pressure in the crankcase chamber to increase toward a discharge pressure in said outlet chamber;

a discharge pressure sensor integrated with said control valve for measuring said discharge pressure; and a suction pressure sensor integrated with said control valve for measuring a refrigerant pressure in said inlet chamber.

2. The capacity control apparatus of claim 1, wherein the control valve includes a plunger partially disposed within the passage coupling the crankcase and outlet chambers that is axially positioned to open and close the passage, said plunger having an axial bore that partially defines a continuous passage between the outlet chamber and a discharge sensor cavity to which said discharge pressure sensor is coupled so that said discharge pressure sensor is continuously exposed to said discharge pressure regardless of the plunger position.

3. The capacity control apparatus of claim 2, where the control valve includes a housing member defining said discharge sensor cavity and a passage coupling said discharge sensor cavity to a chamber in which an outboard end of said plunger is disposed, said housing member additionally defining a stop for limiting outboard movement of said plunger.

4. The capacity control apparatus of claim 3, wherein said housing member additionally includes a suction sensor cavity for said suction pressure sensor and a passage coupling said suction sensor cavity to said inlet chamber.

5. The capacity control apparatus of claim 1, wherein the control valve comprises:

a plunger partially disposed within the passage coupling the crankcase and outlet chambers that is axially positioned to open and close the passage; and an electrically activated solenoid including a permanent magnet pole piece disposed about said plunger, and a moving coil armature affixed to said plunger such that activation of said moving coil armature produces a magnetic force for axially positioning said plunger.

6. The capacity control apparatus of claim 5, wherein said magnetic force positions said plunger to close the passage coupling the crankcase and outlet chambers so that said bleed passage allows the refrigerant pressure in said crankcase chamber to bleed down toward a suction pressure in said inlet chamber, and said control valve includes a spring for positioning said plunger to open the passage coupling the crankcase and outlet chambers in an absence of said magnetic force so that the refrigerant pressure in said crankcase chamber increases toward said discharge pressure.

7. The capacity control apparatus of claim 1, wherein the control valve comprises:

a plunger partially disposed within the passage coupling the crankcase and outlet chambers that is axially positioned to open and close the passage;

a first stop disposed in said passage coupling the crankcase and outlet chambers to define a first limit position of said plunger; and a second stop defining a second limit position of said plunger.

8. The capacity control apparatus of claim 1, wherein the control valve comprises:

a pressure port having an axial bore defining said passage;

a plunger partially disposed within the axial bore of said pressure port and axially positionable therein to open and close said passage; and balance grooves formed on an exterior periphery of said plunger within said axial bore for laterally balancing said plunger within said axial bore.

* * * * *